US010571226B2

(12) United States Patent
Mavencamp

(10) Patent No.: US 10,571,226 B2
(45) Date of Patent: Feb. 25, 2020

(54) MINE-BLAST IMPACT SHIELD AND METHODS FOR USE THEREOF

(71) Applicant: The Boeing Company, Chicago, IL (US)

(72) Inventor: Larry A. Mavencamp, Bothell, WA (US)

(73) Assignee: The Boeing Company, Chicago, IL (US)

( * ) Notice: Subject to any disclaimer, the term of this patent is extended or adjusted under 35 U.S.C. 154(b) by 773 days.

(21) Appl. No.: 15/045,194

(22) Filed: Feb. 16, 2016

(65) Prior Publication Data

US 2017/0234655 A1 Aug. 17, 2017

(51) Int. Cl.

| | |
|---|---|
| ***F41A 23/20*** | (2006.01) |
| ***F41H 5/007*** | (2006.01) |
| ***F41H 5/04*** | (2006.01) |
| ***F41H 5/18*** | (2006.01) |
| ***F41H 3/00*** | (2006.01) |
| ***F41H 5/08*** | (2006.01) |
| ***A43B 3/00*** | (2006.01) |
| ***A43B 3/02*** | (2006.01) |

(52) U.S. Cl.

CPC ..... *F41H 5/007* (2013.01); *A43B 3/0026* (2013.01); *A43B 3/02* (2013.01); *F41A 23/20* (2013.01); *F41H 3/00* (2013.01); *F41H 5/0492* (2013.01); *F41H 5/08* (2013.01); *F41H 5/18* (2013.01); *A43B 3/0005* (2013.01)

(58) Field of Classification Search

CPC ... A43B 3/0005; A43B 3/0031; A43B 3/0042; A43B 3/02; A43B 3/0026; F42D 5/05; F42D 5/00; F41H 1/00; F41H 1/02; F41H 5/007; F41H 5/08

USPC ..... 36/136, 28, 29, 96

See application file for complete search history.

(56) References Cited

U.S. PATENT DOCUMENTS 4,611,411 A * 9/1986 Ringler ..... A43B 3/0026 36/1

5,926,977 A * 7/1999 Sanders ..... A43B 3/0026 36/7.1 R (Continued)

FOREIGN PATENT DOCUMENTS

CN 203369408 U 1/2014

OTHER PUBLICATIONS

Jiri Chladek, Mine Resistant Boots, http://www.jmu.edu/cisr/journal/6.2/features/jirichladek/jirichladek.htm (last visited Feb. 16, 2016).

(Continued)

*Primary Examiner* — Alissa J Tompkins
*Assistant Examiner* — Cameron A Carter
(74) *Attorney, Agent, or Firm* — McDonnell Boehnen Hulbert & Berghoff LLP

(57) ABSTRACT

Apparatus and methods for reducing injury or damage from an explosive device are disclosed. An example apparatus includes a housing and at least one inflator coupled to the housing. The apparatus also includes a shield coupled to the housing. The shield has a plurality of channels coupled to the at least one inflator. The shield also has a compact position and an expanded position. The plurality of channels are configured to receive a fluid from the at least one inflator and thereby at least partially advance the shield from the compact position to the expanded position.

20 Claims, 11 Drawing Sheets

(56) References Cited

U.S. PATENT DOCUMENTS 5,979,081 A * 11/1999 Vaz ..... A43B 3/0026 36/107
6,343,385 B1 * 2/2002 Katz ..... A42B 3/00 2/410
6,505,421 B1 * 1/2003 Vaz ..... A43B 3/0026 36/25 R
6,725,572 B1 * 4/2004 Krstic ..... A43B 1/14 36/107
6,751,892 B2 * 6/2004 Chavet ..... A43B 3/0026 36/113
6,854,136 B2 * 2/2005 Leonard ..... E03D 9/032 4/231
8,522,664 B2 * 9/2013 Chen ..... A43B 7/32 2/2.5
8,677,881 B2 * 3/2014 Tillotson ..... F42D 5/045 89/36.01
2003/0009906 A1 * 1/2003 Auberry ..... A43B 1/0009 36/7.1 R
2003/0172554 A1 * 9/2003 Chavet ..... A43B 3/0026 36/113
2003/0180517 A1 * 9/2003 Karall ..... A43B 3/0026 428/304.4
2005/0183290 A1 * 8/2005 Cantrell ..... A43B 3/0026 36/116
2006/0000117 A1 * 1/2006 Joynt ..... A43B 3/0026 36/113
2009/0090024 A1 * 4/2009 Phlawadana ..... A41D 17/00 36/1.5
2014/0190266 A1 * 7/2014 Strozier ..... G01H 1/00 73/658

OTHER PUBLICATIONS

AIGIS Anti Mine Boots, http://www.goren-kidon.com/welcome/our-partners/aigis/aigis-anti-mine-boot/ (last visited Feb. 16, 2016).

* cited by examiner

MINE-BLAST IMPACT SHIELD AND METHODS FOR USE THEREOF

FIELD

The disclosure generally relates to an apparatus for reducing impact from an explosive device and, more particularly, to an apparatus that may be incorporated in a boot, body armor or a manned vehicle to reduce impact from a land mine explosion or an improvised explosive device.

BACKGROUND

Known designs for land mine protection boots utilize passive materials (e.g., metal plates, strong fabrics and cohesive or resistive putty) that may resist, in part, the shear forces of a land mine explosion. For example, these boots may have soles that are several inches thicker than standard boots and/or incorporate tabre which is constructed from tiny, resin-coated grains of stone to help diffuse the force of the blast from the explosion. These designs are configured to protect an individual's foot but do not contemplate protection for other areas of the individual's body.

In addition, manned vehicles employ a variety of devices to aid in detection and interception of improvised explosive devices, including protective armor.

SUMMARY

In a first aspect of the disclosure, an apparatus is provided that includes a housing and at least one inflator coupled to the housing. The apparatus also includes a shield that is coupled to the housing. The shield has a compact position and an expanded position. The shield includes a plurality of channels coupled to the at least one inflator, and the plurality of channels are configured to receive a fluid from the at least one inflator and thereby at least partially advance the shield from the compact position to the expanded position.

A second aspect is directed to a method for using the apparatus of the first aspect of the invention. One method includes detecting, via a sensor coupled to a housing, at least one of an explosive device and an explosive external force. The method also includes activating a first inflator that is disposed within the housing and thereby deploying a fluid from the first inflator into a plurality of channels of a shield. And the method includes at least partially advancing the shield from a compact position toward an expanded position such that the shield radially extends from the housing.

The features, functions, and advantages that have been discussed can be achieved independently in various examples or may be combined in yet other examples, further details of which can be seen with reference to the following description and drawings.

BRIEF DESCRIPTION OF THE DRAWINGS

Presently preferred examples are described below in conjunction with the appended drawing figures, wherein like reference numerals refer to like elements in the various figures, and wherein.

Corresponding parts are marked with the same reference symbols in all figures.

Figure 1:
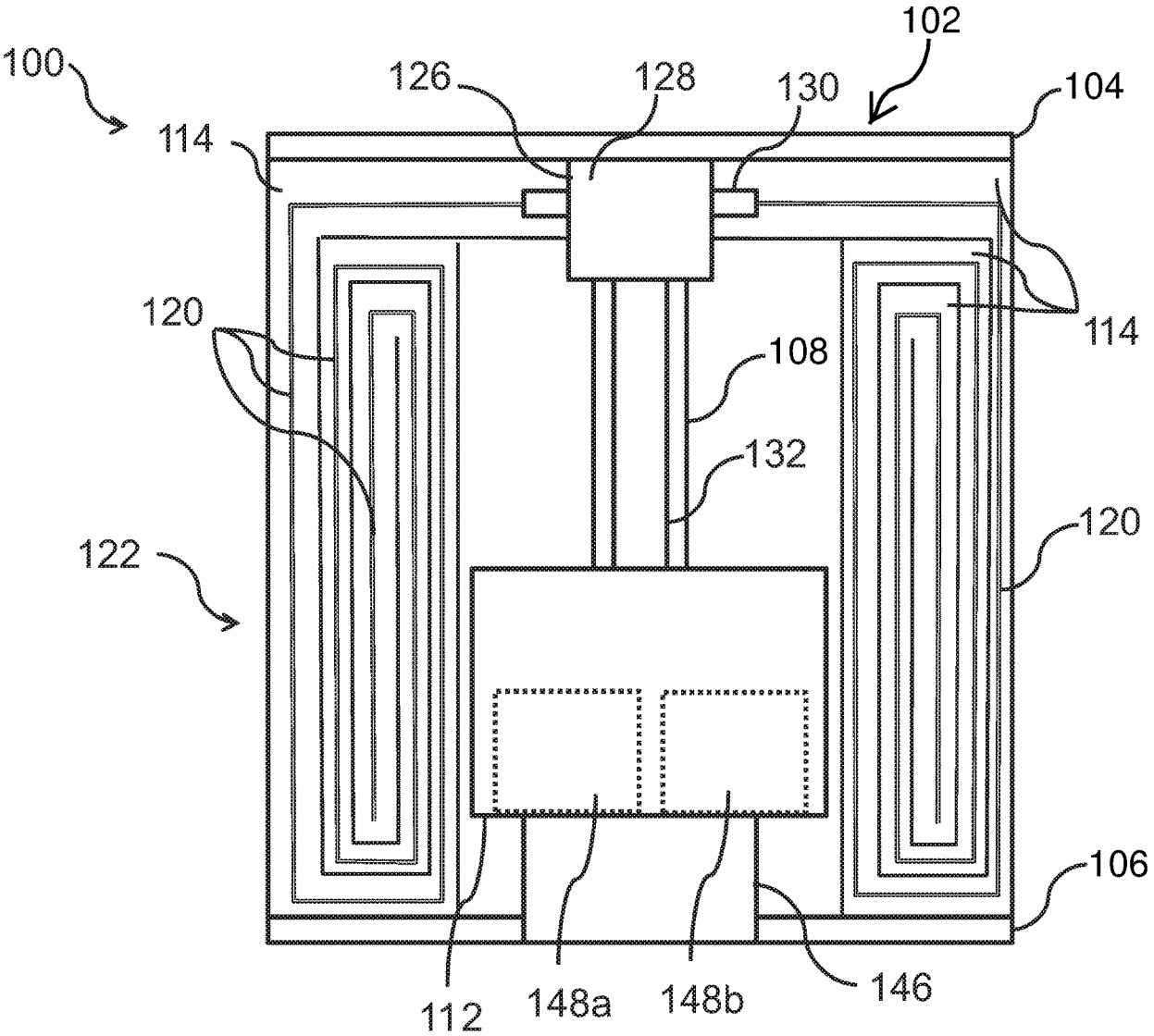
FIG. 1 is a diagrammatic representation of a side view of an apparatus, according to one example, with a shield shown in cross-section rolled in a compact position.

The drawings are provided for the purpose of illustrating examples, but it is understood that the disclosures are not limited to the arrangements and instrumentalities shown in the drawings.

DETAILED DESCRIPTION

The disclosed examples provide an apparatus and methods for reducing impact of explosions caused by land mines and improvised explosive devices, for example. The apparatus may be incorporated into the sole or heel of a boot or coupled to body armor or manned vehicles.

FIGS. 1-6 depict an apparatus 100 that includes a housing 102. The housing 102 may be constructed from resilient materials such as steel, Kevlar® or other aramid-based materials, tabre and combinations thereof, among other possibilities. In one example, the housing 102 may include a first plate 104, a second plate 106 and at least one support 108 extending therebetween and coupling the first plate 104 to the second plate 106. The first plate 104 may be configured for attachment to a boot 110, as described below with respect to FIGS. 8A-D, to body armor (not shown) or to a manned vehicle (not shown), among other possibilities. The second plate 106 of the housing 102 may be arranged to cover an inflator 112 and a shield 114 of the apparatus 100, described below, and may thereby provide protection from the surrounding environment. And, in at least one example shown in FIGS. 8A-D, the second plate 106 may be covered in materials to interface with the ground (e.g. rubber), when the user is walking or running, for example. In one alternative example, as shown in FIG. 9A, the housing 102 may include the first plate 104 coupled to a tube 116. The tube 116 may have either a tubular or polygonal cross-section. The tube 116 may be arranged to surround at least the inflator 112 thereby providing protection from the surrounding environment. In another alternative example, as shown in FIG. 9B, the housing 102 may include the first plate 104 and may optionally include posts 118 or other projections coupled to the first plate 104 of the housing 102 that may protect the inflator 112, for example, from forces from the surrounding environment.

With reference to FIGS. 1-6, the apparatus 100 also includes a shield 114 coupled to the housing 102. The shield 114 may be made of a resilient material, including, but not limited to, Kevlar® or other aramid-based materials, Zetix® or cloth woven from carbon nanotubes, among other possibilities. The shield 114 may be layered to include a layer of resilient material (e.g., Kevlar®), a layer of high acoustic impedance material (e.g., plastic) and a layer of low acoustic impedance material (e.g., foam). This layered arrangement of the shield 114 may reduce the blast impact from a shockwave resulting from an explosion. Optionally, the shield 114 may be covered in a fire retardant material.

Figure 7B:
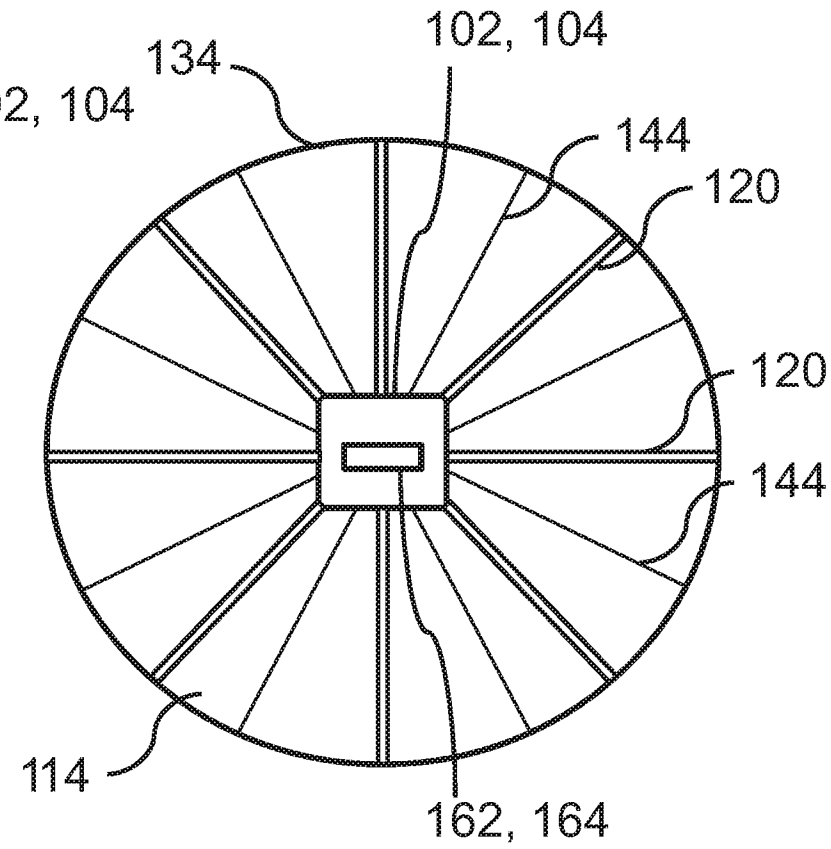
FIG. 7B is a diagrammatic representation of a top view of the apparatus, according to one example, showing a shield in the expanded position.
Figure 7A:
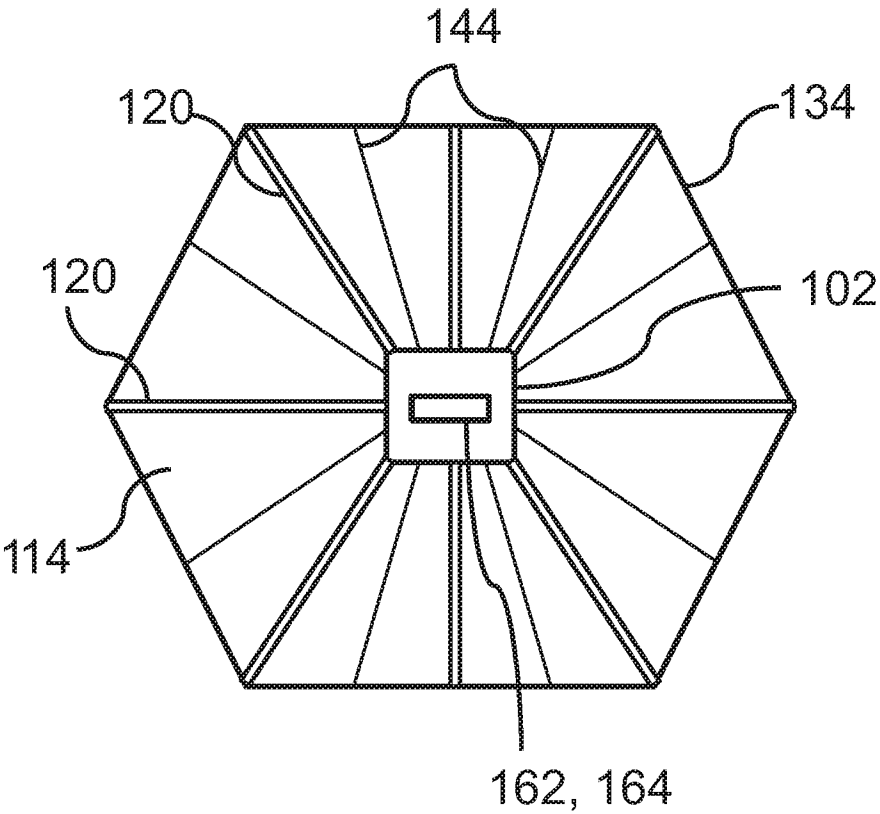
FIG. 7A is a diagrammatic representation of a top view of the apparatus, according to one example, showing a shield in the expanded position.

The shield 114 includes a plurality of channels 120 coupled to the inflator 112. The plurality of channels 120 are configured to receive a fluid from the inflator 112 and thereby at least partially advance the shield 114 from a compact position 122 to an expanded position 124. For example, in one example, the apparatus 100 may include a common fluid distributor 126 having a cavity 128 coupled to each of the plurality of channels 120 of the shield 114 via fluid conduits 130. The common fluid distributor 126 may likewise be coupled to the at least one inflator 112 via a fluid conduit 132. In one example, as shown in FIGS. 7A-B, the housing 102 may be arranged in a center of the shield 114 and the plurality of channels 120 may extend radially from the housing 102 toward a perimeter 134 of the shield 114. The housing 102 may be arranged near the perimeter 134 of the shield 114 to direct the shield 114 across a window of a manned vehicle, for example.

Figure 2:
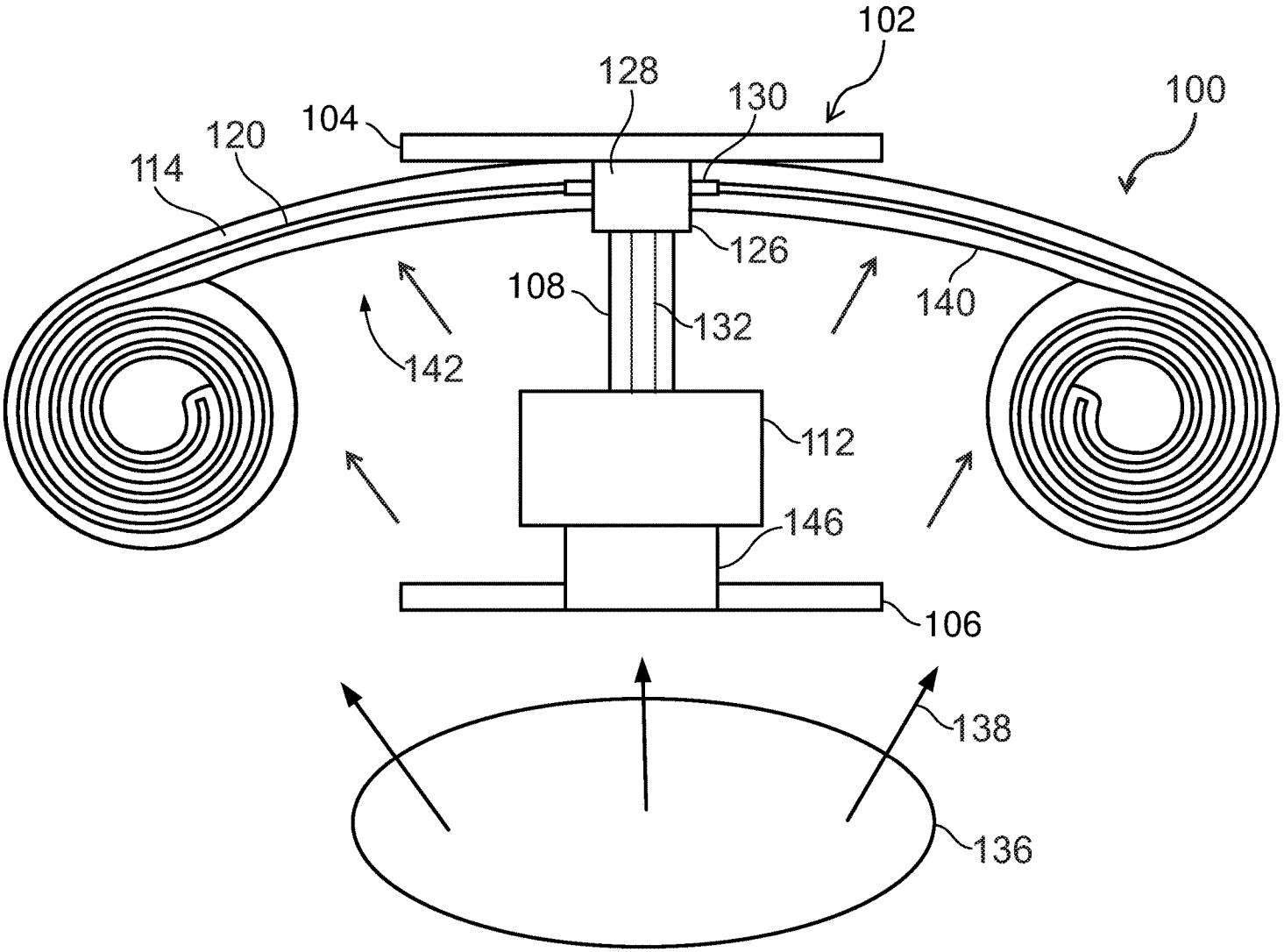
FIG. 2 is a diagrammatic representation of a side view of the apparatus, according to the example of FIG. 1, showing the shield in cross-section transitioning from the compact position to an expanded position.
Figure 3:
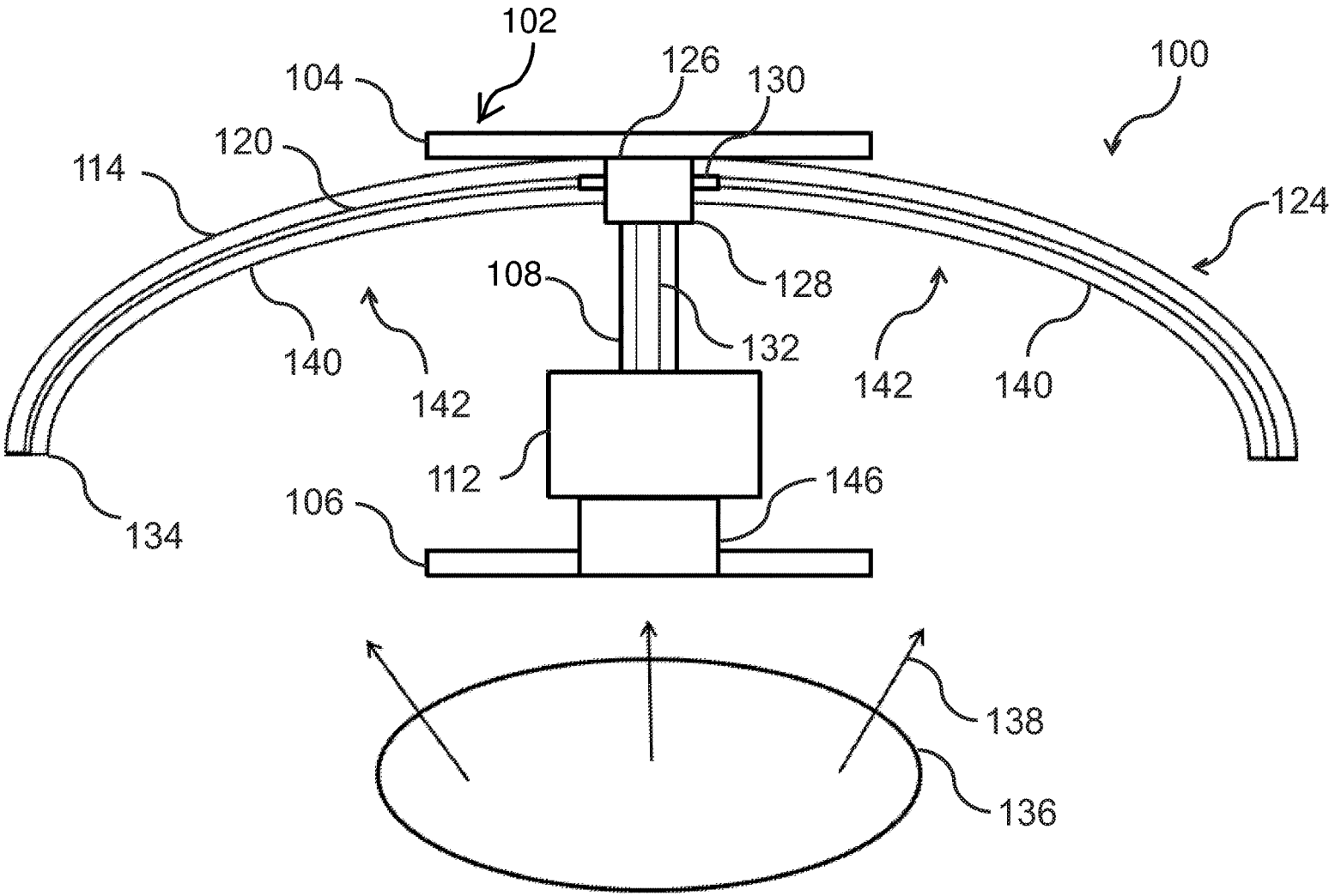
FIG. 3 is a diagrammatic representation of a side view of the apparatus, according to the example of FIG. 1, showing the shield in the expanded position.
Figure 6:
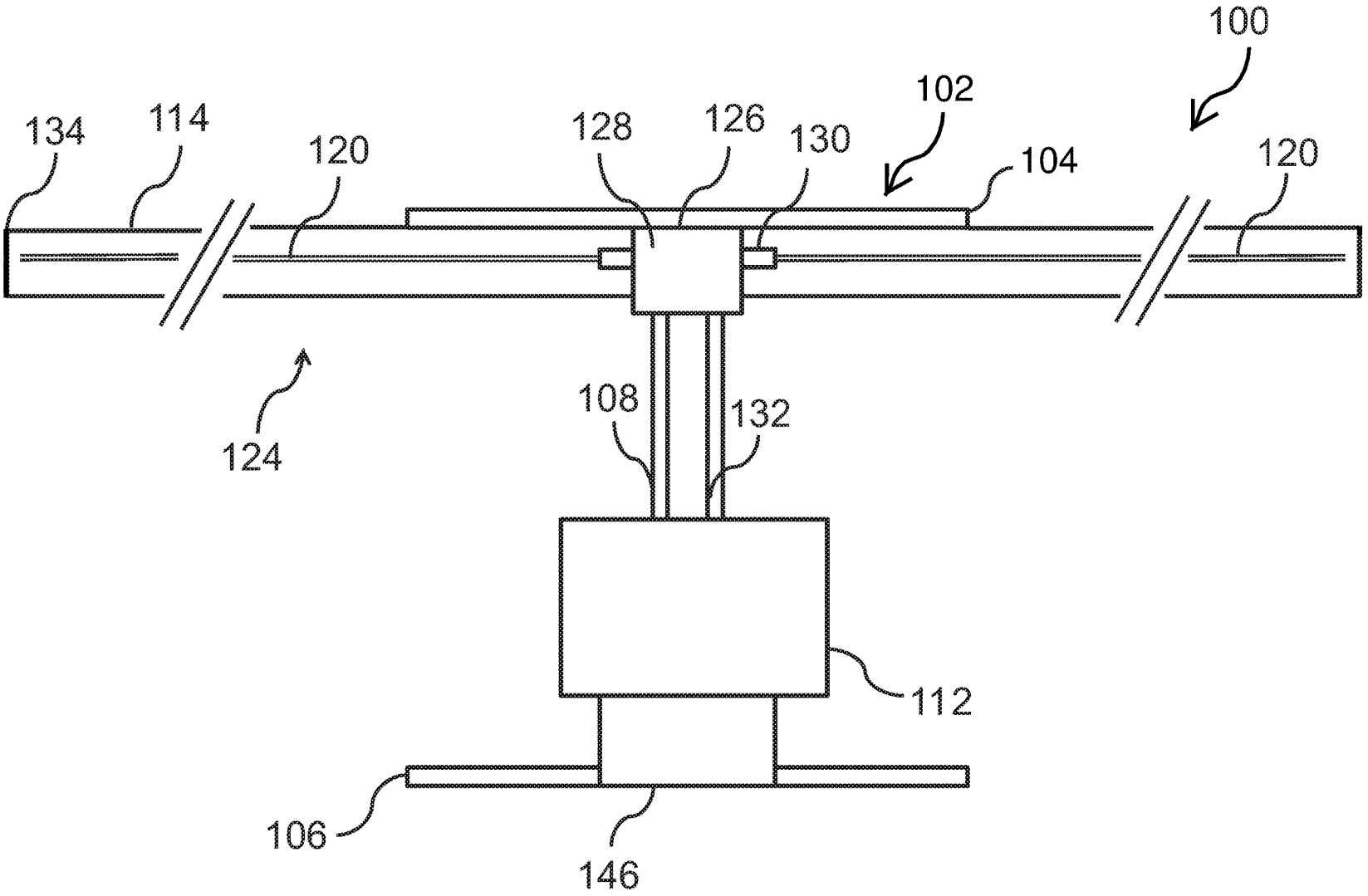
FIG. 6 is a diagrammatic representation of a side view of the apparatus, according to the example of FIG. 4, showing the shield in the expanded position.

At least a portion of the shield 114 is rolled or folded within the housing 102 in the compact position 122 (FIGS. 1, 4), and the shield 114 extends radially from the housing 102 in the expanded position 124 (FIGS. 3, 6). Further, FIG. 2 shows the shield 114 transitioning from the compact position 122 to the expanded position 124 in response to detection of an explosive device 136 or in response to an explosive external force 138, as described in further detail below. The explosive external force 138 may be in the form of static pressure, accelerated gas, accelerated air, projectiles or shrapnel and combinations thereof. The shield 114 may advantageously block or redirect explosive external force 138, for example, reducing the impact the explosive external force 138. The shield 114 may also reduce the energy or pressure resulting from explosive external force 138, including a shockwave, and thereby reduce impact force.

Figure 5:
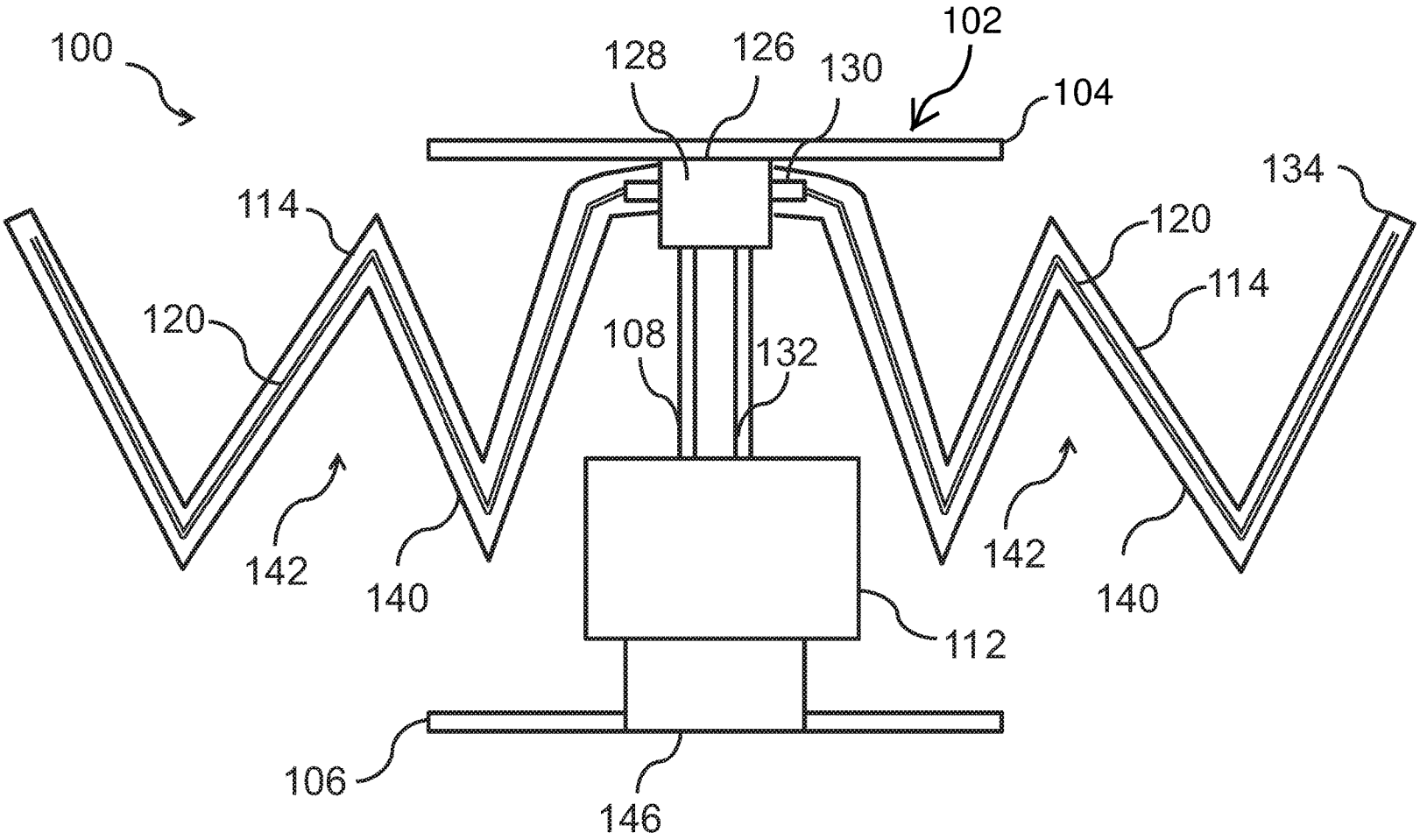
FIG. 5 is a diagrammatic representation of a side view of the apparatus, according to the example of FIG. 4, showing the shield in cross-section transitioning from the compact position to an expanded position.

In the example, shown in FIGS. 2 and 3, the shield 114 may be optionally formed as a canopy 140 defining a cavity 142 in the expanded position 124. At least a portion of the cavity 142 may be exposed to and arranged facing the explosive external force 138 during the transition from the compact position 122 to the expanded position 124. The canopy 140 of the shield 114 may have a dome-shape (FIGS. 3, 7B) or a cone-shape (FIG. 7A). In operation, when an explosive device 136 or an explosive external force 138 is detected, the inflator 112 may deploy a fluid into a plurality of channels 120 of the shield 114. In response to a force resulting from deployment of the fluid in the plurality of channels 120, the shield 114 may transition out of the compact position 122 thereby at least partially exposing the cavity 142 of the shield 114 to the explosive external force 138. The shield 114 may then function similar to a parachute. For example, the shield 114 may advance further toward the expanded position 124 in response to the explosive external force 138 acting upon a portion of the shield 114 defining the cavity 142. Alternatively, as shown in FIGS. 5-6, the shield 114 may be planar in the expanded position 124.

Optionally, the apparatus 100 may include a plurality of springs 144 coupled to the shield 114 and arranged to extend radially from the housing 102 toward a perimeter 134 of the shield 114. The plurality of springs 144 may each be a flexible wire having shape memory with a straight configuration in a relaxed condition and each wire may be flexible to permit rolling or folding to preload the wire in a stressed condition when the shield 114 is in the compact position 122. The plurality of springs 144 may be made of metal alloys including, but not limited to nickel-titanium, copper-aluminum-nickel, copper-zinc-aluminum, and iron-manganese-silicon alloys, among other possibilities.

The shield 114 may be configured to be held in the compact position 122 via a vacuum seal. For example, a vacuum source (not shown) may be coupled to the plurality of channels 120 of the shield 114 by way of the common fluid distributor 126, for example. Then a negative pressure may be applied via the vacuum source such that the shield 114 curls and rolls inward toward the housing 102 (FIG. 2) or corrugates in folds inward toward the housing 102 (FIG. 5) until the shield 114 reaches the compact position 122. A valve or gate 172 arranged between the cavity 128 of the common fluid distributor 126 and the vacuum source may then be closed, vacuum sealing the shield 114 in the compact position 122 until the inflator 112 is activated. The inflator 112 may be coupled to the common fluid distributor 126 via the same valve or gate 172 used to apply the vacuum seal to the shield 114.

The apparatus 100 may include at least one sensor 146 in mechanical, electrical, or electro-mechanical communication with the inflator 112. The sensor 146 may include one or more of an accelerometer, a transducer, a thermal sensor, a chemical sensor, an imaging sensor, a magnetic sensor, an electromagnetic sensor, an acoustic sensor, a seismic acoustic sensor, a hyperspectral sensor, an electro-optical sensor, an optical sensor, and combinations thereof, among other possibilities. The apparatus 100 may include a controller configured to send and/or receive signals between the sensor 146 and the inflator 112.

Figure 4:
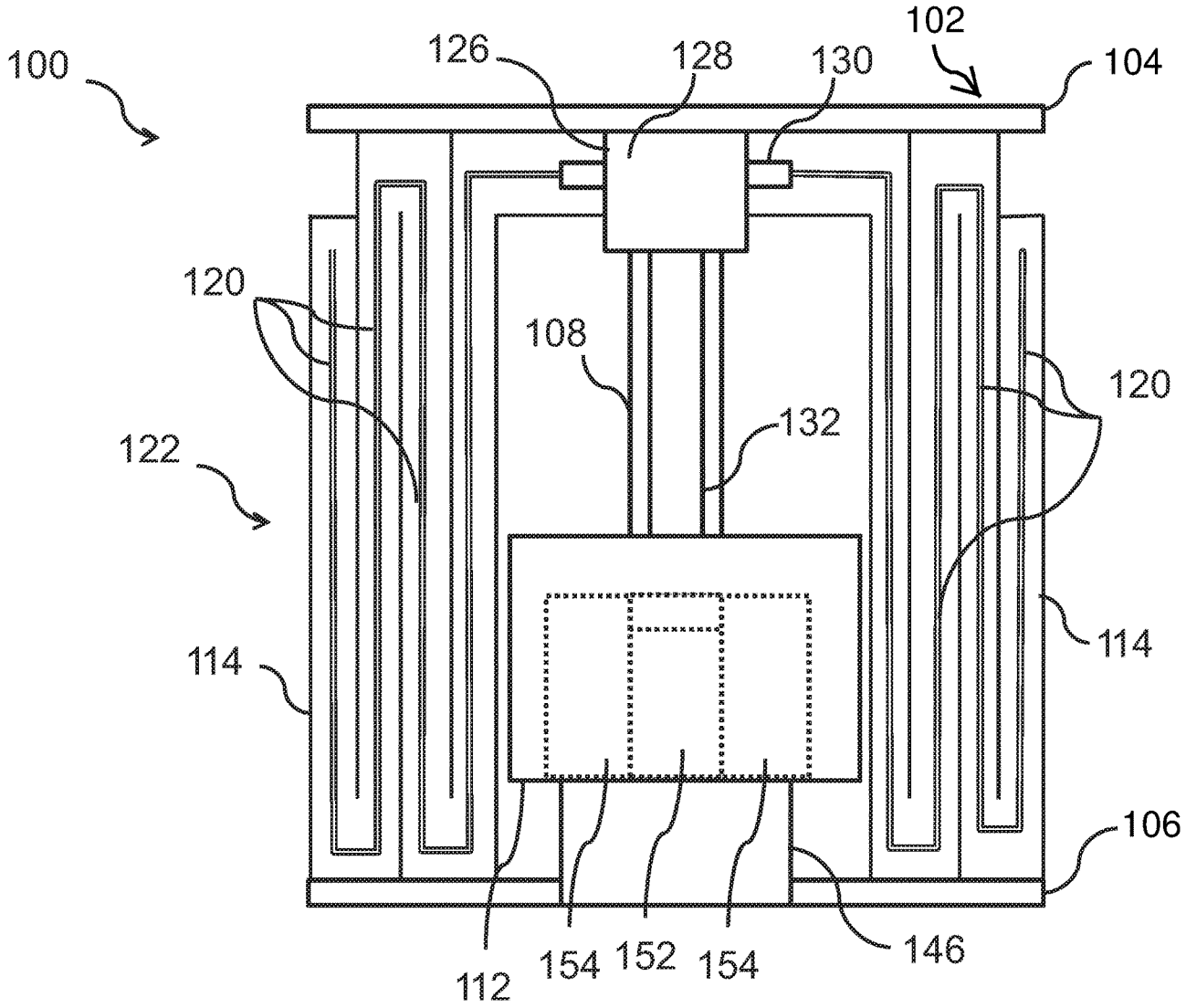
FIG. 4 is a is a diagrammatic representation of a side view of an apparatus, according to one example, showing a shield in cross-section folded in a compact position.

In one example, shown in FIG. 1, the inflator 112 may include two chemicals 148*a,b* that may mix in response to a signal and thereby generate a fluid in the form of a gas or foam, for example. The inflator 112 may include sodium azide (NaN3) and potassium nitrate (KNO3) that together produce nitrogen gas that is then deployed through the plurality of channels 120 of the shield 114 thereby advancing the shield 114 toward the expanded position 124. In another example, shown in FIG. 9B, the inflator 112 may include a compressed gas 150 that may be released and deployed in response to a signal or explosive external force 138. As shown in FIG. 4, the inflator 112 may include an igniter 152 and a solid propellant 154, for example sodium azide, that ignites to create a gas.

As shown in FIGS. 1-6 and 9A-B, the apparatus 100 may include at least one sensor 146 in mechanical, electrical, or electro-mechanical communication with the inflator 112. In response to a signal from the sensor 146, the inflator 112 may release and mix the two chemicals 148*a,b*, release the compressed gas 150 or ignite the solid propellant 154 via the igniter 152. The sensor 146 may include one or more of an accelerometer, a transducer, a thermal sensor, a chemical sensor, an imaging sensor, a magnetic sensor, an electro-magnetic sensor, an acoustic sensor, a seismic acoustic sensor, a hyperspectral sensor, an electro-optical sensor, an optical sensor, and combinations thereof.

Referring now to FIGS. 9A-B, the apparatus 100 may provide a first inflator 112*a* and a second inflator 112*b*, each coupled to the plurality of channels 120 of the shield 114 (see FIGS. 1-6) via fluid conduits 130 of the common fluid distributor 126, according to one optional embodiment. The first inflator 112*a* may be configured to generate a first fluid and the second inflator 112*b* may be configured to generate a second fluid. The first fluid and the second fluid may be the same or different as described above. In operation, the first inflator 112*a* and the second inflator 112*b* may be activated at the same time or in succession. For example, in FIG. 9A, the first inflator 112*a* may optionally be joined with the second inflator 112*b* via a coupling 156. The first inflator 112*a* and the second inflator 112*b* are thereby configured to deploy the first fluid and the second fluid, respectively, into the common fluid distributor 126 and the plurality of channels 120 of the shield 114 (see FIGS. 1-6), when the coupling 156 is displaced. More specifically, displacement of the coupling 156 due to an explosive external force 138 may trigger a sensor 146 to activate the first and second inflators 112*a,b*, for example. Optionally, as shown in FIG. 9B, the first inflator 112*a* may be coupled to at least one sensor 146, and the first inflator 112*a* may be configured to transfer the first fluid to the plurality of channels 120 in response to a signal from the sensor 146. In addition, the second inflator 112*b* may be configured to transfer the second fluid to the plurality of channels 120 in response to the second inflator 112*b* being compressed. For example, the second inflator 112*b*, as shown in FIG. 9B, may contain a compressed gas 150 and may have a bellows-like or corrugated cross-section such that, upon application of an explosive external force 138, the second inflator 112*b* is compressed toward the common fluid distributor 126 advancing the compressed gas 150 into the plurality of channels 120 of the shield 114.

Figure 8B:
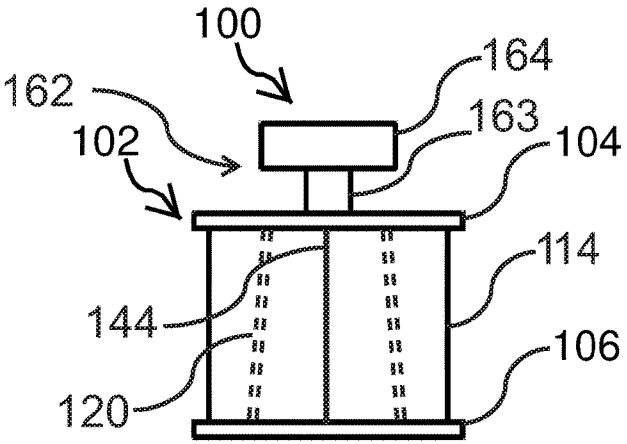
FIG. 8B is a diagrammatic representation of a side view of the housing of the apparatus, according to one example, for coupling with the boot shown in FIG. 8A.
Figure 8C:
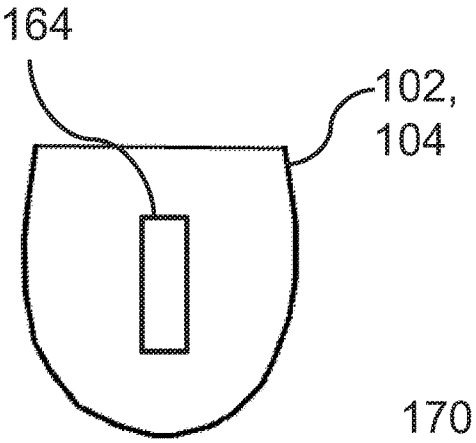
FIG. 8C is a diagrammatic representation of a top view of the housing of the apparatus, according to the example of FIG. 8B.
Figure 8D:
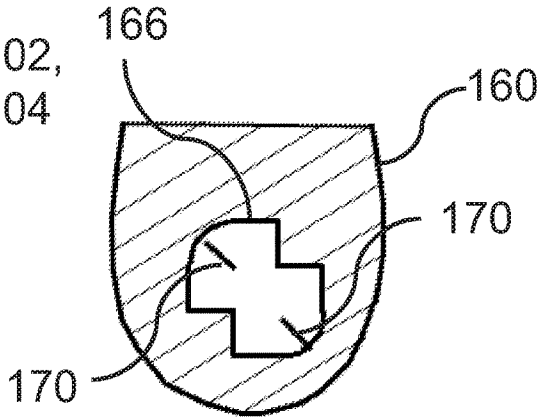
FIG. 8D is a diagrammatic representation of a cross-sectional bottom view of a heel of the boot of the apparatus, according to the example of FIG. 8A.
Figure 8A:
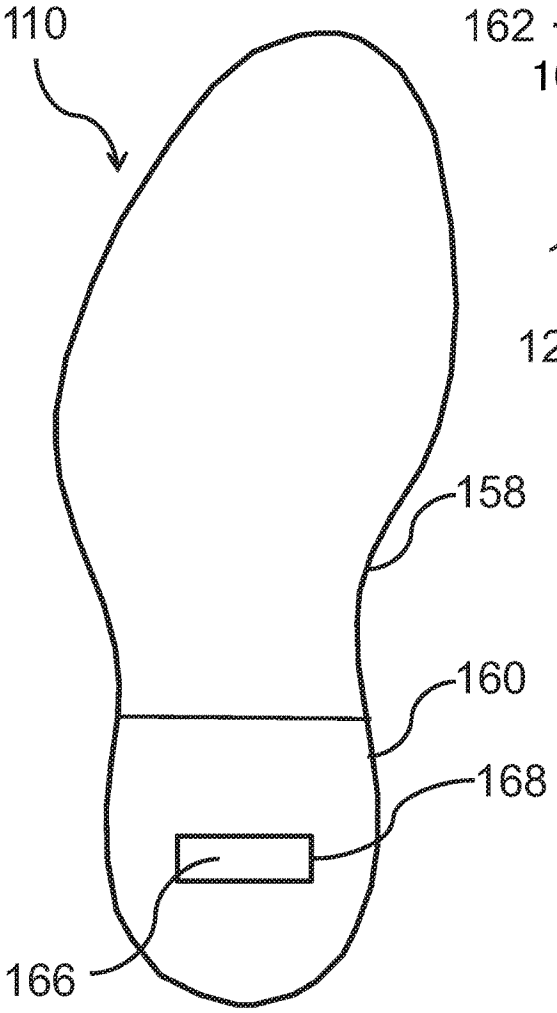
FIG. 8A is a diagrammatic representation of a bottom view of a boot of the apparatus, according to one example, to which a housing may be coupled.
Figure 9A:
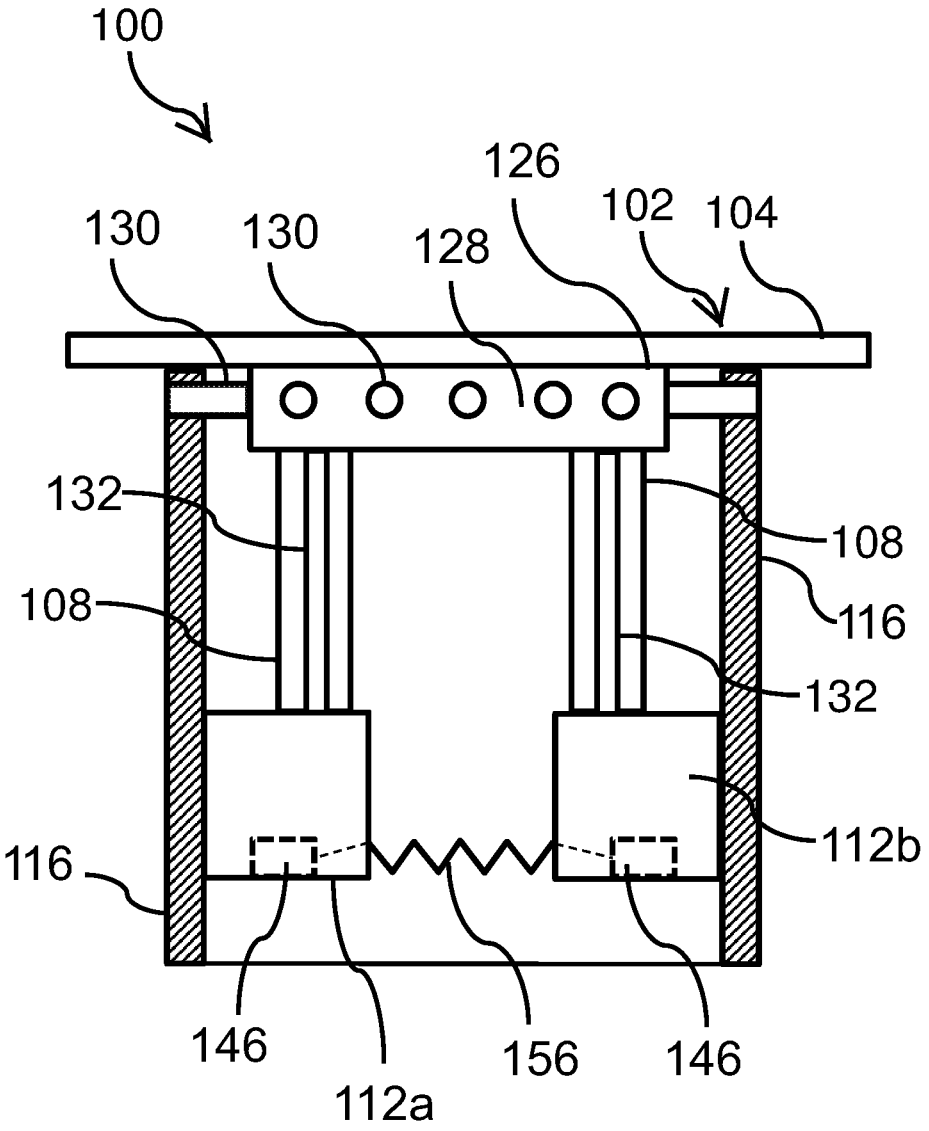
FIG. 9A is a diagrammatic representation of a side view of the apparatus, according to one example, shown without the shield.
Figure 9B:
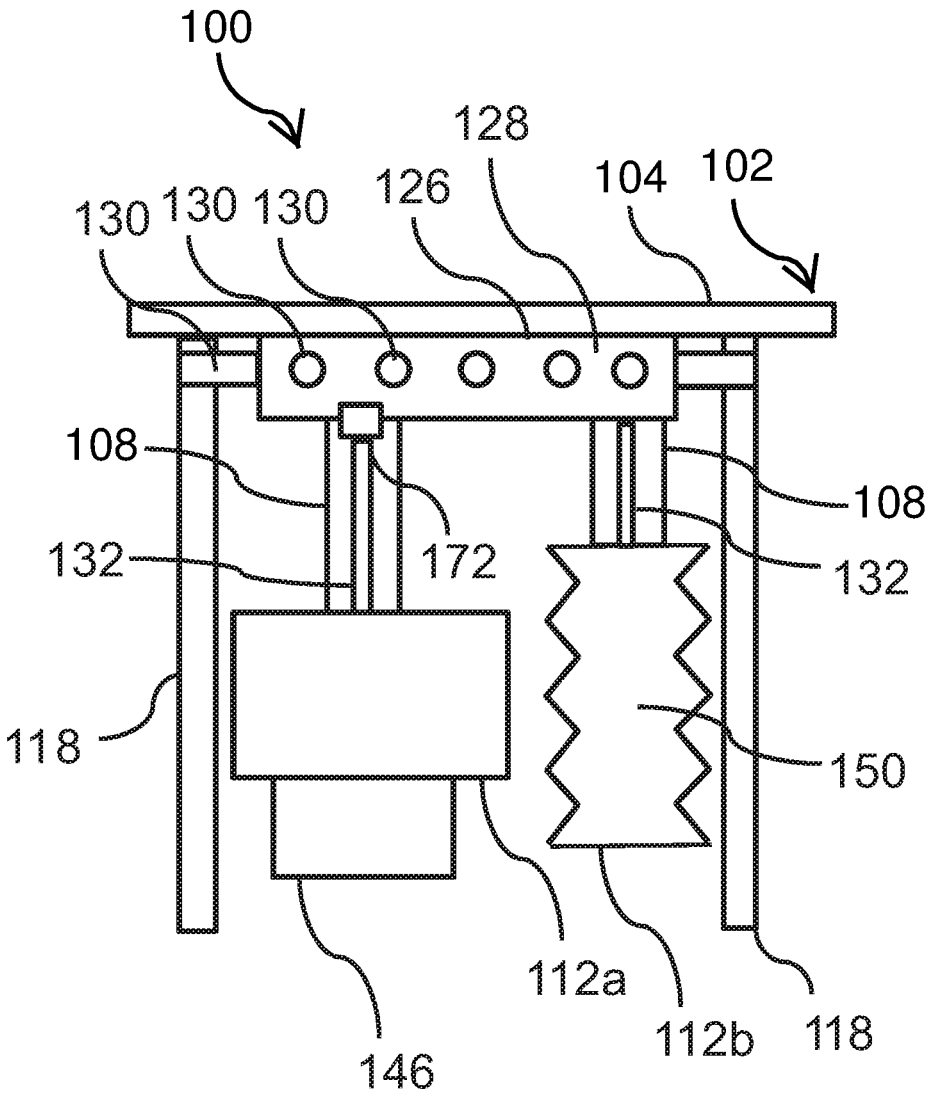
FIG. 9B is a diagrammatic representation of a side view of the apparatus, according to one example, shown without the shield.

With respect to FIGS. 8A-D, in this particular example, the housing 102 may be configured as a sole 158 or heel 160 of a boot 110, and the apparatus 100 may further include a boot 110. As used herein, a "boot" may be any type of footwear. For example, a fastener 162 may be provided to removably couple the housing 102 to the boot 110, as shown in FIGS. 8A-C. The fastener 162 may include (i) a protuberance 163 having a polygonal-shaped knob 164 coupled to an exterior surface of the housing 102 (FIG. 8B) and (ii) a void 166 defined in a sole 158 or a heel 160 of the boot 110 (FIG. 8A). The sole 158 or heel 160 may have an opening 168 to the void 166 sized and shaped to receive the polygonal-shaped knob 164. The fastener 162 is described herein with respect to a boot 110, but the fastener 162 is not so limited and may be utilized to couple the apparatus 100 to a manned vehicle or to body armor, among other possibilities. In addition, other fastener configurations are contemplated.

Optionally, as shown in FIG. 8D, the void 166 of the fastener 162 may have at least one detent 170 arranged such that, when the polygonal-shaped knob 164 is received through the opening 168 into the void 166, the housing 102 is capable of rotating 90 degrees past the at least one detent 170 to align the housing 102 with the heel 160 or the sole 158 of the boot 110 and to lock the housing 102 to the boot 110. In operation, upon deployment of the shield 114, downward pressure may be applied on the boot 110, for example, and rotate the boot 110 to release the housing 102 from the boot 110. In a deployed state, the shield 114 attached to the boot 110 via housing 102 may deflect force from subsequent external explosive forces.

Figure 10:
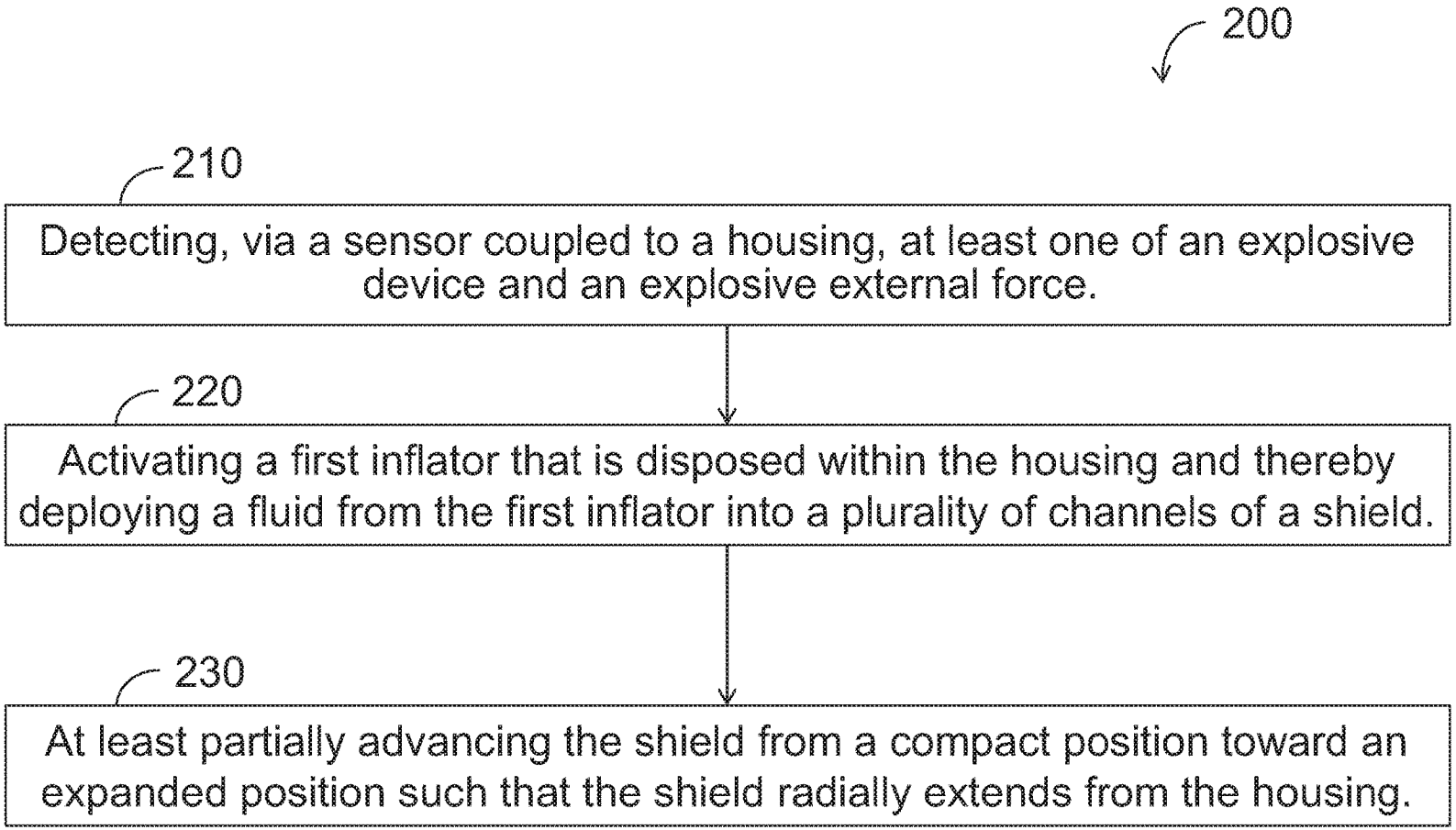
FIG. 10 is a flow diagram of an example method for using the apparatus and transitioning a shield from a compact position to an expanded position.

FIG. 10 illustrates a method 200 for using the apparatus 100 shown in FIGS. 1-9B. Referring now to FIGS. 1-10, method 200 includes, at block 210, detecting, via a sensor 146 coupled to a housing 102, at least one of an explosive device 136 and an explosive external force 138. At block 220, a first inflator 112*a* disposed within the housing 102 is activated, thereby deploying a fluid from the first inflator 112*a* into a plurality of channels 120 of a shield 114. And at block 230, the shield 114 is at least partially advanced from a compact position 122 toward an expanded position 124 such that the shield 114 radially extends from the housing 102.

The shield 114 may include a canopy 140 having a cavity 142 in the expanded position 124, and method 200 may include at least partially advancing the shield 114 toward the expanded position 124 in response to the explosive external force 138 acting upon at least a portion of the shield 114 defining the cavity 142.

The method 200 may include compressing a second inflator 112*b*, via the explosive external force 138, and thereby deploying a fluid from the second inflator 112*b* into the plurality of channels 120 of the shield 114.

The method 200 may include applying a vacuum seal, via a vacuum source, to the plurality of channels 120 of the shield 114 and to a common fluid distributor 126 coupled to the plurality of channels 120. Once the shield 114 advances to the compact position 122, method 200 includes closing a valve or a gate 172 disposed between a cavity 128 of the common fluid distributor 126 and the vacuum source and thereby holding the shield 114 in the compact position 122 within the housing 102.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all examples that come within the scope and spirit of the following claims and equivalents thereto are claimed.

I claim:

1. An apparatus to block or redirect explosive external force comprising:

a housing;

at least one inflator coupled to the housing; and a shield coupled to the housing, the shield having a plurality of channels coupled to the at least one inflator, the shield having a compact position and an expanded position, the plurality of channels configured to receive a fluid from the at least one inflator and thereby at least partially advance the shield from the compact position to the expanded position, wherein the housing is arranged in a center of the shield and the plurality of channels are coupled to the shield and extend radially from the housing toward a perimeter of the shield in the expanded position; and wherein at least a portion of the shield is rolled or folded within the housing in the compact position and the shield extends radially from the housing and is planar in the expanded position.

2. The apparatus of claim 1, wherein the shield has a canopy defining a cavity in the expanded position, the shield configured to at least partially advance from the compact position to the expanded position in response to an external force acting upon a portion of the shield defining the cavity.

3. The apparatus of claim 2, wherein the canopy of the shield has a dome-shape or a cone-shape.

4. The apparatus of claim 1, further comprising:

at least one sensor in mechanical, electrical, or electro-mechanical communication with the at least one inflator.

5. The apparatus of claim 4, wherein the at least one sensor comprises one or more of an accelerometer, a transducer, a thermal sensor, a chemical sensor, an imaging sensor, a magnetic sensor, an electromagnetic sensor, an acoustic sensor, a seismic acoustic sensor, a hyperspectral sensor, an electro-optical sensor, an optical sensor and combinations thereof.

6. The apparatus of claim 1, wherein the at least one inflator has at least (i) two or more chemicals configured to generate a fluid when mixed together, (ii) a compressed gas, (iii) an igniter and a solid propellant configured to generate a fluid in response to the solid propellant igniting or (iv) combinations thereof.

7. The apparatus of claim 1, wherein the at least one inflator comprises a first inflator and a second inflator, wherein the first inflator and the second inflator are coupled to the plurality of channels of the shield and wherein the first inflator is configured to generate a first fluid and the second inflator is configured to generate a second fluid.

8. The apparatus of claim 7, wherein the first inflator is coupled to at least one sensor, and the first inflator is configured to transfer the first fluid to the plurality of channels in response to a signal from the sensor, and wherein the second inflator is configured to transfer the second fluid to the plurality of channels in response to the second inflator being compressed.

9. The apparatus of claim 7, wherein the first inflator is joined with the second inflator via a coupling, and the first inflator and the second inflator are configured to deploy the first fluid and the second fluid, respectively, into the plurality of channels of the shield when the coupling is displaced.

10. The apparatus of claim 1, further comprising:

a common fluid distributor having a cavity coupled to the at least one inflator and each of the plurality of channels of the shield.

11. The apparatus of claim 1, further comprising:

a plurality of springs coupled to the shield and arranged extending radially from the housing toward a perimeter of the shield in the expanded position.

12. The apparatus of claim 11, wherein the plurality of springs each comprise a wire having shape memory with a straight configuration in a relaxed condition and each wire is flexible to permit rolling or folding to preload the wire in a stressed condition when the shield is in the compact position.

13. The apparatus of claim 1, wherein the housing is configured as a sole or a heel of a boot.

14. The apparatus of claim 1, further comprising:

a boot; and a fastener removably coupling the housing to the boot, the fastener comprising (i) a protuberance having a polygonal-shaped knob coupled to an exterior surface of the housing and (ii) a void defined in a sole or a heel of the boot, the void having an opening sized and shaped to receive the polygonal-shaped knob.

15. The apparatus of claim 14, wherein the void of the fastener has at least one detent arranged such that, when the polygonal-shaped knob is received through the opening into the void, the housing is capable of rotating 90 degrees past the at least one detent to align the housing with the heel or the sole of the boot and to lock the housing to the boot.

16. The apparatus of claim 1, wherein the shield is configured to be held in the compact position via a vacuum seal.

17. A method for blocking or redirecting an explosive external force comprising:

detecting, via a sensor coupled to a housing, at least one of an explosive device and the explosive external force;

activating a first inflator that is disposed within the housing and thereby deploying a fluid from the first inflator into a plurality of channels of a shield; and at least partially advancing the shield from a compact position toward an expanded position such that the shield radially extends from the housing, wherein the housing is arranged in a center of the shield and the plurality of channels are coupled to the shield and extend radially from the housing toward a perimeter of the shield in the expanded position; and wherein at least a portion of the shield is rolled or folded within the housing in the compact position and the shield extends radially from the housing and is planar in the expanded position.

18. The method of claim 17, wherein the shield comprises a canopy having a cavity in the expanded position, the method further comprising:

at least partially advancing the shield toward the expanded position in response to the explosive external force acting upon at least a portion of the shield defining the cavity.

19. The method of claim 18, comprising:

compressing a second inflator, via the explosive external force, and thereby deploying a fluid from the second inflator into the plurality of channels of the shield.

20. The method of claim 17, comprising:

applying a vacuum seal, via a vacuum source, to the plurality of channels of the shield and to a common fluid distributor coupled to the plurality of channels; and closing a valve or a gate disposed between a cavity of the common fluid distributor and the vacuum source and thereby holding the shield in the compact position within the housing.

* * * * *